US010228171B2

(12) United States Patent
Kudo et al.

(10) Patent No.: US 10,228,171 B2
(45) Date of Patent: Mar. 12, 2019

(54) ACCUMULATOR, AIR-CONDITIONING APPARATUS AND METHOD FOR MANUFACTURING ACCUMULATOR

(71) Applicant: Mitsubishi Electric Corporation, Tokyo (JP)

(72) Inventors: Jumpei Kudo, Tokyo (JP); Mizuo Sakai, Tokyo (JP); Yusuke Shimazu, Tokyo (JP); Masanori Aoki, Tokyo (JP); Motoki Otsuka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 185 days.

(21) Appl. No.: 15/026,630

(22) PCT Filed: Sep. 30, 2014

(86) PCT No.: PCT/JP2014/076204
§ 371 (c)(1),
(2) Date: Apr. 1, 2016

(87) PCT Pub. No.: WO2015/093126
PCT Pub. Date: Jun. 25, 2015

(65) Prior Publication Data

US 2016/0245563 A1 Aug. 25, 2016

(30) Foreign Application Priority Data

Dec. 19, 2013 (JP) ..... 2013-262662

(51) Int. Cl.
*F25B 43/00* (2006.01)
*F25B 13/00* (2006.01)
*F25B 41/00* (2006.01)

(52) U.S. Cl.
CPC ..... *F25B 43/006* (2013.01); *F25B 13/00* (2013.01); *F25B 41/003* (2013.01);
(Continued)

(58) Field of Classification Search
CPC ..... F25B 43/006; F25B 2400/16; F25B 43/00
See application file for complete search history.

(56) References Cited

U.S. PATENT DOCUMENTS

| | | | |
|---|---|---|---|
| 6,681,597 | B1 | 1/2004 | Yin et al. |
| 2006/0010905 | A1 | 1/2006 | Gu |
| 2006/0213220 | A1 | 9/2006 | Takahashi et al. |

FOREIGN PATENT DOCUMENTS

| | | |
|---|---|---|
| JP | 54-108454 | 7/1979 |
| JP | 56-144279 | 10/1981 |

(Continued)

OTHER PUBLICATIONS

Machine Translation of JPU56-144279.*

(Continued)

*Primary Examiner* — David Teitelbaum
(74) *Attorney, Agent, or Firm* — Posz Law Group, PLC

(57) ABSTRACT

An accumulator includes a container, a low pressure refrigerant inlet tube, and a low pressure refrigerant outlet body including an upstream-side tubular section, a low pressure refrigerant turning back section and a downstream-side tubular section in the container. At least a part of the upstream-side tubular section is covered by a first outer tube with a gap between the upstream-side tubular section and the first outer tube, at least a part of the downstream-side tubular section is covered by a second outer tube with a gap between the downstream-side tubular section and the second outer tube, the first outer tube and the second outer tube communicate with each other via a bridging tube, and high pressure refrigerant passes through the gap between the upstream-side tubular section and the first outer tube, the bridging tube, and the gap between the downstream-side tubular section and the second outer tube.

14 Claims, 7 Drawing Sheets

(52) U.S. Cl.
CPC ..... *F25B 2313/0233* (2013.01); *F25B 2313/0272* (2013.01); *F25B 2400/051* (2013.01); *F25B 2400/054* (2013.01)

(56) References Cited

FOREIGN PATENT DOCUMENTS

| | | | |
|---|---|---|---|
| JP | 61-083849 | A | 4/1986 |
| JP | 2004-156896 | A | 6/2004 |
| JP | 2005-098581 | A | 4/2005 |
| JP | 2006-273049 | A | 10/2006 |
| JP | 2009-150573 | A | 7/2009 |
| JP | 2011-163671 | A | 8/2011 |

OTHER PUBLICATIONS

Machine Translation of JP 2005-098581.*
Office Action dated May 10, 2016 in the corresponding JP Application No. 2013-262662 (with English translation).
Office Action dated Jul. 5, 2016 issued in corresponding CN patent Application No. 201410785635.7 (and English translation).
Office Action dated Dec. 6, 2016 issued in corresponding JP patent Application No. 2013-262662 (and English translation).
Australian Office Action dated Mar. 9, 2017 issued in corresponding AU application No. 2014368147.
Extended European Search Report dated Jun. 21, 2017 issued in corresponding EP application No. 14870798.7.
International Search Report of the International Searching Authority dated Dec. 22, 2014 for the corresponding international application No. PCT/JP2014/076204 (and English translation).

* cited by examiner

ACCUMULATOR, AIR-CONDITIONING APPARATUS AND METHOD FOR MANUFACTURING ACCUMULATOR

CROSS REFERENCE TO RELATED APPLICATION

This application is a U.S. national stage application of International Application No. PCT/JP2014/076204 filed on Sep. 30, 2014, and is based on Japanese Patent Application No. 2013-262662 filed on Dec. 19, 2013, the disclosures of which are incorporated herein by reference.

TECHNICAL FIELD

The present invention relates to an accumulator, an air-conditioning apparatus and a method for manufacturing an accumulator.

BACKGROUND ART

A conventional accumulators include a container that seals low pressure refrigerant, a low pressure refrigerant inlet tube that allows the low pressure refrigerant to flow into the container, and a U-shaped tube that allows the low pressure refrigerant in the container to flow out of the container, and the U-shaped tube is covered by an outer tube with a gap between the U-shaped tube and the outer tube. High pressure refrigerant passes through the gap between the U-shaped tube and the outer tube, and the high pressure refrigerant exchanges heat with the low pressure refrigerant in the container and the low pressure refrigerant in the U-shaped tube. This heat exchange allows the low pressure refrigerant in the container and the low pressure refrigerant in the U-shaped tube to be gasified and superheated, and the high pressure refrigerant passing through the gap between the U-shaped tube and the outer tube to be subcooled (for example, see Patent Literature 1).

CITATION LIST

Patent Literature

Patent Literature 1: Japanese Unexamined Patent Application Publication No. 61-83849 (line 14 in the upper left column to line 4 in the lower left column on page 3, and FIG. 1)

SUMMARY OF INVENTION

Technical Problem

In the conventional accumulators, a straight tube is inserted in the outer tube and the outer tube is bent with the straight tube to form a turning back section of the U-shaped tube. Thus, it is difficult to ensure a gap between the U-shaped tube and the outer tube at the turning back section, causing a problem of low manufacturing efficiency. Further, there is a problem that how to apply such a conventional accumulator to air-conditioning apparatuses configured to switch heating operation and cooling operation by switching operation of a flow switching mechanism in a refrigerant circuit, which has become more complicated over the years, is not embodied.

The present invention has been made in view of these problems, and has an object of providing an accumulator with an improved manufacturing efficiency. Further, the present invention has an object of providing an air-conditioning apparatus having the same accumulator. Further, the present invention has an object of providing an air-conditioning apparatus in which application of the accumulator is embodied. Further, the present invention has an object of providing a method of manufacturing an accumulator with an improved manufacturing efficiency.

Solution to Problem

An accumulator according to the present invention is an accumulator connected to a refrigerant circuit and includes a container sealing low pressure refrigerant flowing through a low pressure side of the refrigerant circuit, a low pressure refrigerant inlet tube allowing the low pressure refrigerant to flow into the container, and a low pressure refrigerant outlet body including an upstream-side tubular section, a low pressure refrigerant turning back section communicating with a lower end of the upstream-side tubular section, and a downstream-side tubular section having a lower end communicating with the low pressure refrigerant turning back section in the container, and is configured to allow the low pressure refrigerant in the container to flow from an upper end of the upstream-side tubular section to an upper end of the downstream-side tubular section and to flow out of the container. At least a part of the upstream-side tubular section is covered by a first outer tube with a gap between the upstream-side tubular section and the first outer tube, at least a part of the downstream-side tubular section is covered by a second outer tube with a gap between the downstream-side tubular section and the second outer tube, the first outer tube and the second outer tube communicate with each other via a bridging tube, and high pressure refrigerant flowing through a high pressure side of the refrigerant circuit passes through the gap between the upstream-side tubular section and the first outer tube, the bridging tube, and the gap between the downstream-side tubular section and the second outer tube.

Advantageous Effects of Invention

In the accumulator according to the present invention, the first outer tube and the second outer tube communicate with each other via the bridging tube, and thus the low pressure refrigerant turning back section does not need to be covered by the outer tube. Thus, it is not necessary to reliably ensure the gap in forming the turning back section of the low pressure refrigerant outlet body, thereby improving the manufacturing efficiency of the low pressure refrigerant outlet body.

DESCRIPTION OF EMBODIMENTS

Figure 1:
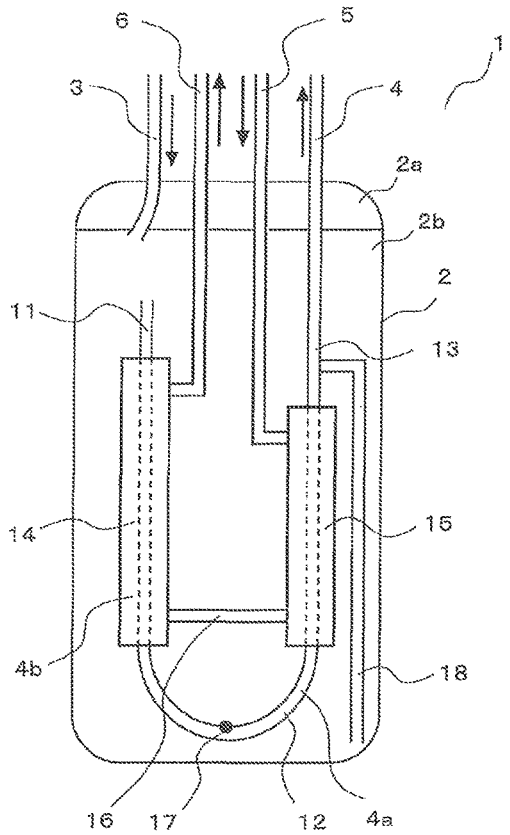
FIG. 1 is a view showing the configuration and operation of an accumulator according to Embodiment 1.

With reference to the drawings, an accumulator according to the present invention will be described.

The configurations, operations, manufacturing process, and other descriptions below are merely examples, and an accumulator according to the present invention is not limited to such configurations, operations, a manufacturing process, and other descriptions. Detailed structures are simplified or omitted in the drawings as appropriate. Further, duplicated descriptions are simplified or omitted as appropriate.

Embodiment 1

An accumulator according to Embodiment 1 will be described below.

<Configuration and Operation of Accumulator>

The configuration and operation of the accumulator according to Embodiment 1 will be described below.

Figure 2:
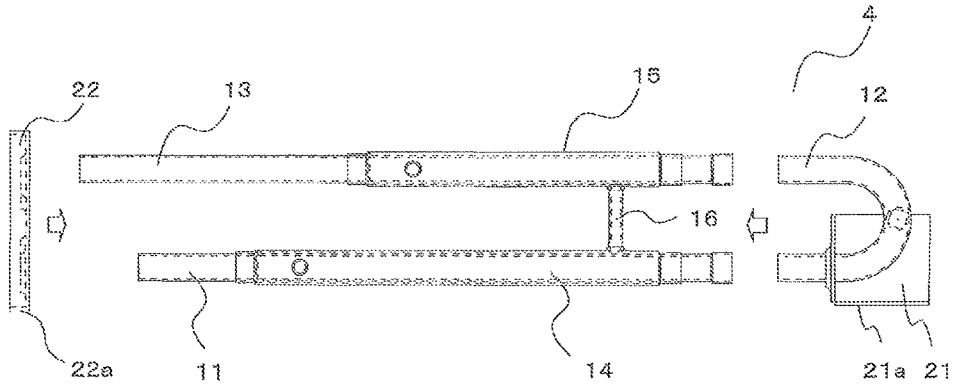
FIG. 2 is a view showing the configuration and operation of the accumulator according to Embodiment 1.
Figure 3:
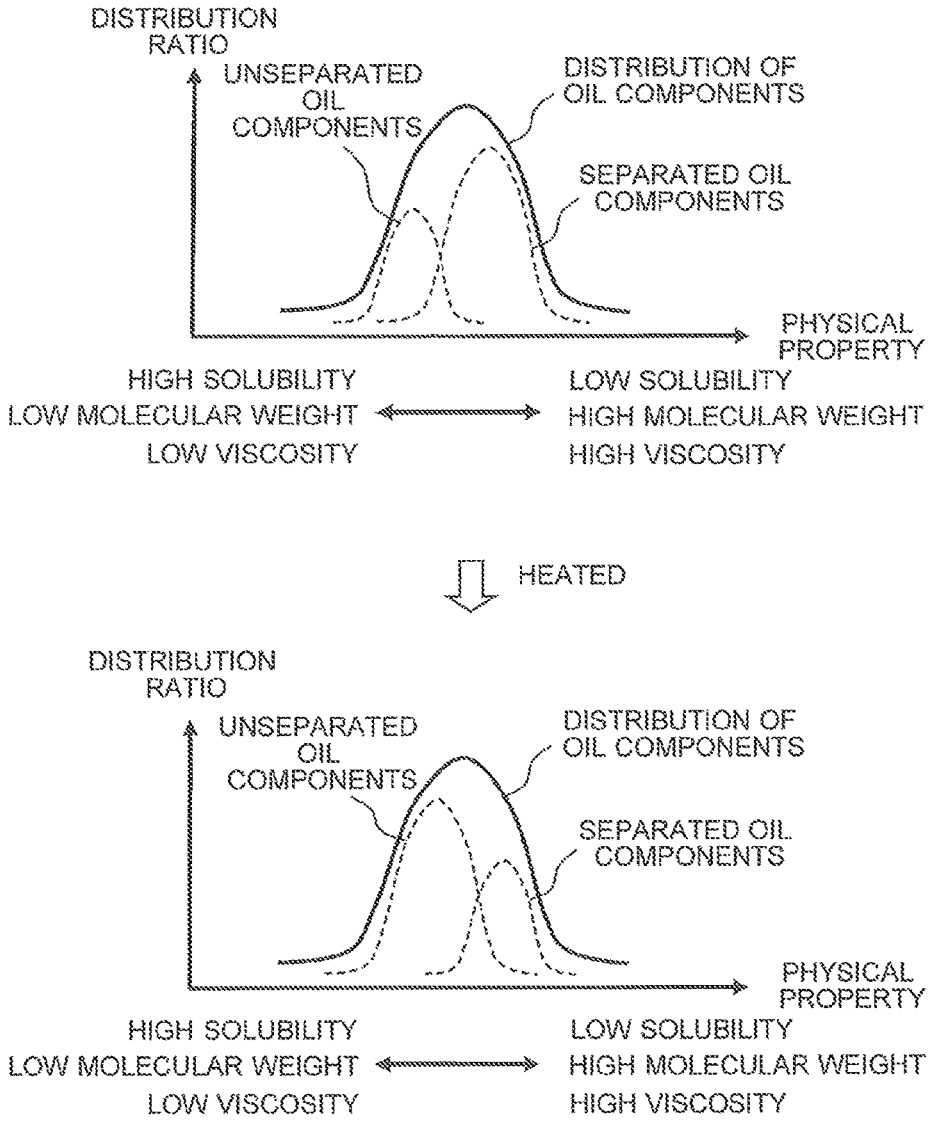
FIG. 3 is a graph showing the configuration and operation of the accumulator according to Embodiment 1.

FIGS. 1 to 3 are views and a graph showing the configuration and operation of the accumulator according to Embodiment 1.

As shown in FIG. 1, an accumulator 1 includes a container 2, a low pressure refrigerant inlet tube 3, a low pressure refrigerant outlet body 4, a high pressure refrigerant inlet tube 5, and a high pressure refrigerant outlet tube 6. The container 2 seals low pressure refrigerant. The low pressure refrigerant inlet tube 3 allows low pressure refrigerant to flow into the container 2. The low pressure refrigerant outlet body 4 allows low pressure refrigerant to flow out of the container 2. The high pressure refrigerant inlet tube 5 allows high pressure refrigerant to flow into the container 2. The high pressure refrigerant outlet tube 6 allows high pressure refrigerant to flow out of the container 2.

The container 2 is preferably made up of a cap 2*a* and a shell 2*b*, and the low pressure refrigerant inlet tube 3, the low pressure refrigerant outlet body 4, the high pressure refrigerant inlet tube 5, and the high pressure refrigerant outlet tube 6 are fixed penetrating through through-holes formed in the cap 2*a*. With this configuration, the low pressure refrigerant inlet tube 3, the low pressure refrigerant outlet body 4, the high pressure refrigerant inlet tube 5, and the high pressure refrigerant outlet tube 6 can be mounted in the container 2 while the container 2 is open, and after that, the container 2 can be sealed by a simple operation of joining the cap 2*a*. Thus, manufacturing efficiency of the accumulator 1 can be improved.

The low pressure refrigerant outlet body 4 includes a first tube 11 that extends from an upper position to a lower position in the container 2, a U-shaped tube 12 that is connected to the lower end of the first tube 11 and a second tube 13 having a lower end connected to the U-shaped tube 12. As shown in FIG. 2, the first tube 11, the U-shaped tube 12, and the second tube 13 are separate members. The low pressure refrigerant enters the container 2, flows from the upper end of the first tube 11 to the low pressure refrigerant outlet body 4, passes through the first tube 11, the U-shaped tube 12, and the second tube 13 in this order, and exits the container 2. The flow path of the low pressure refrigerant outlet body 4 through which low pressure refrigerant flows is hereinafter referred to as a low pressure refrigerant flow path 4*a*. The U-shaped tube 12 may not be in U-shape and may be a block that forms a U-shaped flow path. The first tube 11 corresponds to an "upstream-side tubular section" of the present invention. The U-shaped tube 12 corresponds to a "low pressure refrigerant turning back section" of the present invention. An area of the second tube 13 that is located in the container 2 corresponds to a "downstream-side tubular section" of the present invention.

The first tube 11 the U-shaped tube 12, and the second tube 13 of the low pressure refrigerant outlet body 4 may be a unitary member, that is, a unitary U-shaped tube. In that case, a portion of the unitary U-shaped tube that corresponds to the first tube 11 corresponds to the "upstream-side tubular section" of the present invention. A portion of the unitary U-shaped tube that corresponds to the U-shaped tube 12 corresponds to the "low pressure refrigerant turning back section" of the present invention. A portion of the unitary U-shaped tube that corresponds to the area of the second tube 13 that is located in the container 2 corresponds to the "downstream-side tubular section" of the present invention.

The first tube 11, the U-shaped tube 12, and the second tube 13 of the low pressure refrigerant outlet body 4 are formed as separate members, and thus more members (such as the U-shaped tube 12) can be used in common by a plurality of accumulators 1 having different volumes compared with the case where the first tube 11, the U-shaped tube 12, and the second tube 13 are formed as a unitary U-shaped tube, thereby reducing the manufacturing cost. Further, in the case where the first tube 11, the U-shaped tube 12, and the second tube 13 are formed as a unitary U-shaped tube, both ends of the unitary U-shaped tube expand to a certain extent due to a spring effect of the turning back section. However, when the first tube 11, the U-shaped tube 12, and the second tube 13 are formed as separate members, expansion between both ends of the U-shaped tube 12 can be easily reduced or eliminated since the U-shaped tube 12 is formed as a separate member, and thus, expansion between the upper end of the first tube 11 and the upper end of the second tube 13 can be prevented. As a result, a sealing property of low pressure refrigerant in the container 2 can be improved and a productivity in manufacturing of the accumulator 1 can be improved.

At least a part of the first tube 11 is covered by a first outer tube 14 with a gap between the first tube 11 and the first outer tube 14. The first outer tube 14 is connected to the high pressure refrigerant outlet tube 6. At least a part of the second tube 13 is covered by a second outer tube 15 with a gap between the second tube 13 and the second outer tube 15. The second outer tube 15 is connected to the high pressure refrigerant inlet tube 5. The first outer tube 14 and the second outer tube 15 communicate with each other via a bridging tube 16. After the high pressure refrigerant enters the high pressure refrigerant inlet tube 5 into the gap between the second tube 13 and the second outer tube 15, it flows through the bridging tube 16, the gap between the first tube 11 and the first outer tube 14, and the high pressure refrigerant outlet tube 6 in sequence and exits the container 2. The flow path of the low pressure refrigerant outlet body 4 through which high pressure refrigerant flows is hereinafter referred to as a high pressure refrigerant flow path 4*b*.

The first outer tube 14 and the second outer tube 15 communicate with each other via the bridging tube 16, and thus the U-shaped tube 12 does not need to be covered by an outer tube. Thus, it is not necessary to reliably ensure the gap between the U-shaped tube 12 and the outer tube in forming the U-shaped tube 12, that is, the turning back section of the low pressure refrigerant outlet body 4, thereby improving manufacturing efficiency of the low pressure refrigerant outlet body 4.

Further, low pressure refrigerant passing through the container 2 and the low pressure refrigerant flow path 4*a* exchanges heat with high pressure refrigerant passing through the high pressure refrigerant flow path 4*b*. This heat exchange promotes gasification and superheat of the low pressure refrigerant passing through the container 2 and the low pressure refrigerant flow path 4*a* so that gas refrigerant that is sufficiently superheated and contains little liquid refrigerant flows out of the low pressure refrigerant outlet body 4, and promotes subcooling of the high pressure refrigerant passing through the high pressure refrigerant flow path 4*b* so that liquid refrigerant that is sufficiently subcooled flows out of the high pressure refrigerant outlet tube 6.

Further, low pressure refrigerant passing through the low pressure refrigerant flow path 4*a* and high pressure refrigerant passing through the high pressure refrigerant flow path 4*b* flow in mutually opposite directions. Thus, compared with the case where they flow in the same direction, low pressure refrigerant passing through a downstream-side area of the low pressure refrigerant flow path 4*a* has a large temperature difference to the high pressure refrigerant, and high pressure refrigerant passing through a downstream-side area of the high pressure refrigerant flow path 4*b* has a large temperature difference to the low pressure refrigerant. This temperature difference improves heat exchange efficiency in the low pressure refrigerant outlet body 4 and further promotes gasification and superheat of the low pressure refrigerant passing through the container 2 and the low pressure refrigerant flow path 4*a* and subcooling of the high pressure refrigerant passing through the high pressure refrigerant flow path 4*b*.

Moreover, the first tube 11, the U-shaped tube 12, and the second tube 13 of the low pressure refrigerant outlet body 4 are formed as separate members, and thus more members (such as the U-shaped tube 12) can be used in common by a low pressure refrigerant outlet body of a type having the first tube 11 and the second tube 13 that are not covered by an outer tube, thereby reducing the manufacturing cost.

The first outer tube 14 preferably has a length larger than that of the second outer tube 15. With this configuration, gasification of low pressure refrigerant around the first tube 11 is further promoted, and thus liquid refrigerant is reliably prevented from entering the upper end of the first tube 11, and increase of pressure loss generated in the high pressure refrigerant passing through the high pressure refrigerant flow path 4*b* due to the excessively long high pressure refrigerant flow path 4*b* can also be prevented.

The U-shaped tube 12 has an oil return hole 17. The oil return hole 17 is located at a lower position in the container 2, particularly, at a lower position relative to the bridging tube 16. The oil return hole 17 allows the oil accumulated at the bottom of the container 2, for example, lubricating oil for the compressor to flow into the low pressure refrigerant flow path 4*a* and to flow out along with the low pressure refrigerant from the accumulator 1. The oil return hole 17 is formed in the U-shaped tube 12, which is not covered by an outer tube, and thus manufacturing efficiency of the low pressure refrigerant outlet body 4 can be improved. The oil return hole 17 corresponds to an "oil inlet flow path" of the present invention.

A downstream-side area of the second tube 13 is not covered by the second outer tube 15 and is connected to one end of a straw tube 18. The other end (distal end) of the straw tube 18 is located at a lower position in the container 2, particularly, at a lower position relative to the bridging tube 16. The straw tube 18 allows the oil accumulated at the bottom of the container 2, for example, lubricating oil for the compressor to be suctioned into the low pressure refrigerant flow path 4*a*. The straw tube 18 is connected to the downstream-side area of the second tube 13 that is not covered by an outer tube, and thus manufacturing efficiency of the low pressure refrigerant outlet body 4 can be improved. Further, the straw tube 18 is connected to the area close to an outlet port of the low pressure refrigerant flow path 4*a*, and thus head difference between both ends of the straw tube 18 increases and suctioning of the oil accumulated at the bottom of the container 2, for example, lubricating oil for the compressor is promoted. The straw tube 18 corresponds to the "oil inlet flow path" of the present invention.

The bridging tube 16 is located at an upper position relative to the oil return hole 17 and the distal end of the straw tube 18, and thus separation between oil, for example, lubricating oil for the compressor and liquid refrigerant in the container 2 is promoted. That is, as shown in FIG. 3, oil that flows into the container 2, for example, lubricating oil for the compressor tends to contain oil components having different solubility, and oil components having low solubility are separated from the liquid refrigerant, but oil components having high solubility are solved in the liquid refrigerant and are not separated from the liquid refrigerant. If the bridging tube 16 is located at a lower position relative to the oil return hole 17 and the distal end of the straw tube 18, the oil accumulated at the bottom of the container 2, for example, lubricating oil for the compressor and liquid refrigerant are heated by the bridging tube 16, thus increasing oil components that are not separated. On the other hand, in the configuration in which the bridging tube 16 is located at an upper position relative to the oil return hole 17 and the distal end of the straw tube 18, the oil accumulated at the bottom of the container 2, for example, lubricating oil for the compressor and liquid refrigerant are prevented from being heated by the bridging tube 16, and thus oil components that are not separated are prevented from increasing. This prevention promotes two-layering of oil in the container 2 of, for example, lubricating oil for the compressor and liquid refrigerant. As a result, oil returning property of oil in the accumulator 1, for example, lubricating oil for the compressor is improved, thereby further improving reliability of prevention of failure of compressor or other troubles.

Moreover, the low pressure refrigerant outlet body 4 may include only one of the oil return hole 17 and the straw tube 18. In particular, when the flow rate of low pressure refrigerant passing through the low pressure refrigerant flow path 4*a* largely varies depending on an operation state of the compressor or other factors, it is preferable that the low pressure refrigerant outlet body 4 includes the oil return hole 17 and the straw tube 18.

As shown in FIG. 2, a support member 21 is fixed to the U-shaped tube 12. A support member 22 is fixed to the high pressure refrigerant inlet tube 5, which is not shown, the high pressure refrigerant outlet tube 6, which is not shown, the first tube 11, and the second tube 13. The support members 21 and 22 have outer peripheral surfaces 21*a* and 22*a* that are shaped along an inner peripheral surface of the shell 2*b* and are attached on the inner peripheral surface of the shell 2*b*.

<Method for Manufacturing Accumulator>

A method for manufacturing the accumulator according to Embodiment 1 will be described below.

Figure 4:
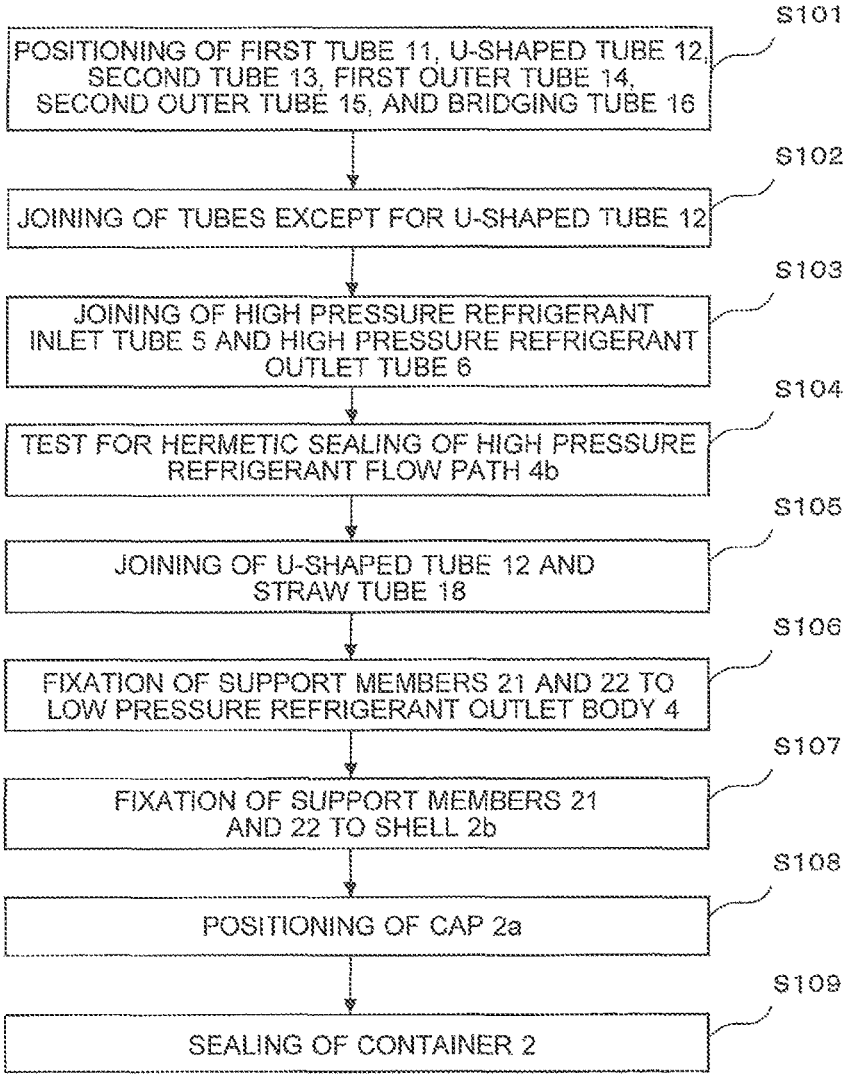
FIG. 4 is a block diagram showing a method for manufacturing the accumulator according to Embodiment 1.

FIG. 4 is a block diagram showing a method for manufacturing the accumulator according to Embodiment 1.

As shown in FIG. 4, in S101, the members are positioned so that at least a part of the first tube 11 is covered by the first outer tube 14 with a gap between the first tube 11 and the first outer tube 14, at least a part of the second tube 13 is covered by the second outer tube 15 with a gap between the second tube 13 and the second outer tube 15, the first outer tube 14 and the second outer tube 15 communicate with each other via the bridging tube 16, and the first tube 11 and the second tube 13 communicate with each other via the U-shaped tube 12. In S102, the tubes except for the U-shaped tube 12 are joined by brazing or other methods. The U-shaped tube 12 may be positioned after S102. The U-shaped tube 12 corresponds to a "relay member" of the present invention.

In S103, the high pressure refrigerant inlet tube 5 is joined to the second outer tube 15 by brazing or other methods and the high pressure refrigerant outlet tube 6 is joined to the first outer tube 14 by brazing or other methods. Then, in S104, test for hermetic sealing of the high pressure refrigerant flow path 4*b* is performed. Through these processes, hermetic sealing property of the high pressure refrigerant flow path 4*b* through which high pressure refrigerant passes can be reliably achieved compared with the low pressure refrigerant flow path 4*a*.

In S105, the U-shaped tube 12 and the straw tube 18 are joined by brazing or other methods to form the low pressure refrigerant outlet body 4. Then, in S106, the support members 21 and 22 are fixed to the low pressure refrigerant outlet body 4. As shown in FIG. 2, when the support member 21 is fixed to the U-shaped tube 12 by swaging a through-hole of the support member 21 with the U-shaped tube 12 being inserted in the through-hole, the support member 21 is preferably fixed before the U-shaped tube 12 is positioned. Through these processes, in the case where the outer diameters of the first outer tube 14 and the second outer tube 15 are each larger than the inner diameter of the corresponding through-hole, unsuccessful mounting of the support member 21 to the U-shaped tube 12 due to the first outer tube 14 and the second outer tube 15 can be prevented. The low pressure refrigerant outlet body 4 corresponds to a "refrigerant outlet body" of the present invention.

In S107, the inner peripheral surface of the shell 2*b* and the outer peripheral surfaces 21*a* and 22*a* of the support members 21 and 22 are joined by welding or other methods. Then, in S108, the cap 2*a* having the low pressure refrigerant inlet tube 3 joined thereto in advance is positioned. Then, in S109, the cap 2*a* is joined to the shell 2*b* to seal the container 2.

Usage Example of Accumulator

A usage example of the accumulator according to Embodiment 1 will be described.

In the accumulator 1 of the following usage example, the first outer tube 14 and the second outer tube 15 may not communicate with each other via the bridging tube 16 as long as at least a part of the low pressure refrigerant flow path 4*a* is covered by an outer tube. That is, for example, the accumulator 1 may include an outer tube that covers the U-shaped tube 12 with a gap between the U-shaped tube and the outer tube so that the first outer tube 14 and the second outer tube 15 communicates with each other via the outer tube.

Usage Example-1

Figure 5:
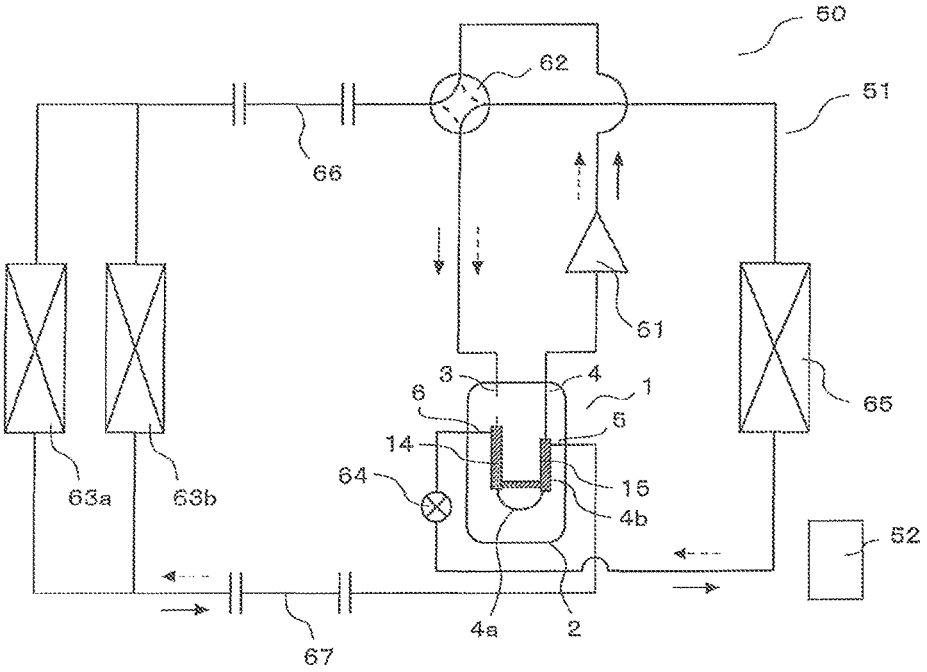
FIG. 5 is a view showing Usage example-1 of the accumulator according to Embodiment 1.
Figure 6:
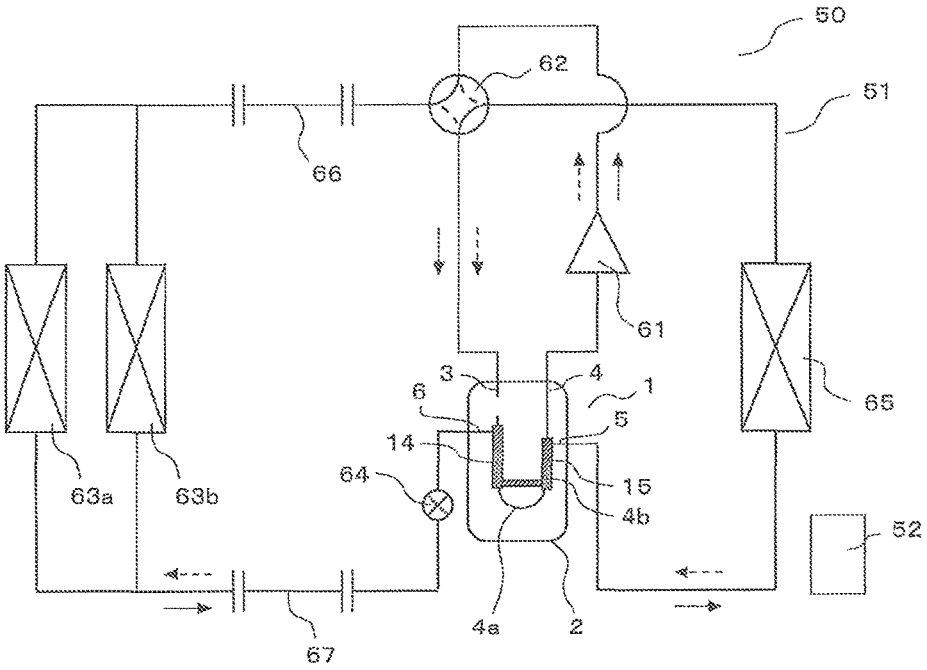
FIG. 6 is a view showing Usage example-1 of the accumulator according to Embodiment 1.

FIGS. 5 and 6 are views showing Usage example-1 of the accumulator according to Embodiment 1. In FIGS. 5 and 6, a flow of refrigerant during heating operation is indicated by the solid arrow, and a flow of refrigerant during cooling operation is indicated by the dotted arrow. Further, a flow path of a four-way valve 62 during heating operation is indicated by the solid line, and a flow path of the four-way valve 62 during cooling operation is indicated by the dotted line.

As shown in FIG. 5, the accumulator 1 is applied to an air-conditioning apparatus 50.

The air-conditioning apparatus 50 includes a refrigerant circuit 51 that connects the accumulator 1, a compressor 61, the four-way valve 62, indoor heat exchangers 63*a* and 63*b*, an expansion device 64, and an outdoor heat exchanger 65 by a pipe including extension pipes 66 and 67, and a controller 52 that controls an operation of the refrigerant circuit 51. Only one of the indoor heat exchangers 63*a* and 63*b* may be provided. The four-way valve 62 may be any other mechanism that can switch a circulation direction of refrigerant discharged from the compressor 61. The four-way valve 62 corresponds to a "first flow switching mechanism" of the present invention. The expansion device 64 corresponds to a "first expansion device" of the present invention.

After flowing through the low pressure refrigerant flow path 4*a* of the accumulator 1, the refrigerant is suctioned into the compressor 61. The high pressure refrigerant flow path 4*b* of the accumulator 1 is connected so that the high pressure refrigerant outlet tube 6 connected to the first outer tube 14 communicates with the expansion device 64, and the high pressure refrigerant inlet tube 5 connected to the second outer tube 15 communicates with the indoor heat exchangers 63*a* and 63*b*.

During heating operation, the controller 52 switches the flow path of the four-way valve 62 as indicated by the solid line shown in FIG. 5. Refrigerant turned into high pressure gas refrigerant in the compressor 61 flows through the four-way valve 62 into the indoor heat exchangers 63*a* and 63*b*, is condensed by exchanging heat with indoor air supplied by a fan or other devices, and becomes subcooled liquid refrigerant. The subcooled liquid refrigerant flows into the high pressure refrigerant flow path 4*b* of the accumulator 1, and becomes further subcooled liquid refrigerant by exchanging heat with low pressure refrigerant passing through the low pressure refrigerant flow path 4*a* of the accumulator 1 and low pressure refrigerant in the container 2 of the accumulator 1. The further subcooled liquid refrigerant flows into the expansion device 64, and is expanded in the expansion device 64 and becomes low pressure two-phase gas-liquid refrigerant. The low pressure two-phase gas-liquid refrigerant flows into the outdoor heat exchanger 65, and is evaporated by exchanging heat with outside air supplied by a fan or other devices. After flowing through the outdoor heat exchanger 65, the refrigerant flows through the four-way valve 62 into the container 2 of the accumulator 1. The refrigerant that flows into the container 2 of the accumulator 1 is superheated or increased in quality by exchanging heat with high pressure refrigerant passing through the high pressure refrigerant flow path 4*b* of the accumulator 1 while the refrigerant passes through the container 2 and the low pressure refrigerant flow path 4*a*, becomes sufficiently superheated gas refrigerant that contains little liquid refrigerant, and is again suctioned into the compressor 61.

During cooling operation, the controller 52 switches the flow path of the four-way valve 62 as indicated by the dotted line shown in FIG. 5. Refrigerant turned into high pressure gas refrigerant in the compressor 61 flows through the four-way valve 62 into the outdoor heat exchanger 65, is condensed by exchanging heat with outside air or other mediums supplied by a fan or other devices, and becomes subcooled liquid refrigerant. The subcooled liquid refrigerant flows into the expansion device 64, is expanded in the expansion device 64, and becomes low pressure two-phase gas-liquid refrigerant. The low pressure two-phase gas-liquid refrigerant flows into the high pressure refrigerant flow path 4*b* of the accumulator 1, and exchanges heat with low pressure refrigerant passing through the low pressure refrigerant flow path 4*a* of the accumulator 1 and low pressure refrigerant in the container 2 of the accumulator 1. The low pressure refrigerant has been reduced in pressure by a pressure loss generated in the extension pipe 66, the indoor heat exchangers 63*a* and 63*b*, and the extension pipe 67. Then, the low pressure two-phase gas-liquid refrigerant flows into the indoor heat exchangers 63*a* and 63*b*, and is evaporated by exchanging heat with indoor air supplied by a fan or other devices. After flowing through the indoor heat exchangers 63*a* and 63*b*, the refrigerant flows through the four-way valve 62 into the container 2 of the accumulator 1. The refrigerant that flows into the container 2 of the accumulator 1 is superheated or increased in quality by exchanging heat with high pressure refrigerant passing through the high pressure refrigerant flow path 4*b* of the accumulator 1 while the refrigerant passes through the container 2 and the low pressure refrigerant flow path 4*a*, and becomes sufficiently superheated gas refrigerant that contains little liquid refrigerant, and is again suctioned into the compressor 61.

That is, when the refrigerant circuit 51 performs heating operation, the low pressure refrigerant passes through the container 2 and the low pressure refrigerant flow path 4*a* before being suctioned into the compressor 61, and the high pressure refrigerant flows into the expansion device 64 after passing through the high pressure refrigerant flow path 4*b*. As a result, gasification and superheat of the low pressure refrigerant passing through the container 2 and the low pressure refrigerant flow path 4*a* can be reliably achieved by using the high pressure refrigerant before being expanded in the expansion device 64 that generates a large pressure difference, and thus gas refrigerant that is sufficiently superheated and contains little liquid refrigerant reliably flows out of the low pressure refrigerant outlet body 4. Thus, it is possible to prevent failure or decrease in operation efficiency of the compressor 61, although the refrigerant circuit 51 is configured to switch heating operation and cooling operation by switching operation of the four-way valve 62. Further, subcooling of the high pressure refrigerant passing through the high pressure refrigerant flow path 4*b* can be reliably achieved by using the low pressure refrigerant before being pressurized in the compressor 61 that generates a large pressure difference, and thus it is possible to reduce the pressure loss generated in the outdoor heat exchanger 65 by decreasing the refrigerant quality on the inlet side of the outdoor heat exchanger 65, although the refrigerant circuit 51 is configured to switch heating operation and cooling operation by switching operation of the four-way valve 62. Moreover, heat exchange efficiency of the outdoor heat exchanger 65 can be improved by enhancing a refrigerant distribution performance of the outdoor heat exchanger 65.

Further, when the refrigerant circuit 51 performs heating operation, the low pressure refrigerant passing through the low pressure refrigerant flow path 4*a* and the high pressure refrigerant passing through the high pressure refrigerant flow path 4*b* flow in mutually opposite directions. As a result, compared with the case where they flow in the same direction, gasification and superheat of the low pressure refrigerant passing through the low pressure refrigerant flow path 4*a* and subcooling of the high pressure refrigerant passing through the high pressure refrigerant flow path 4*b* can be further reliably achieved. Thus, it is possible to further prevent failure and decrease in operation efficiency of the compressor 61 and to further promote reduction in pressure loss generated in the outdoor heat exchanger 65 and improvement of heat exchange efficiency of the outdoor heat exchanger 65, although the refrigerant circuit 51 is configured to switch heating operation and cooling operation by switching operation of the four-way valve 62.

In particular, when the refrigerant circuit 51 performs heating operation, the high pressure refrigerant that has passed through the high pressure refrigerant flow path 4*b* flows into the expansion device 64, and the low pressure refrigerant passing through the low pressure refrigerant flow path 4*a* and the high pressure refrigerant passing through the high pressure refrigerant flow path 4*b* flow in mutually opposite directions. During heating operation, air that exchanges heat with refrigerant in the evaporator tends to have low temperature compared with that during cooling operation, and thus superheat of refrigerant tends to be difficult. Thus, preferential improvement in heat exchange efficiency in the low pressure refrigerant outlet body 4 during heating operation makes it possible, at a low cost, to prevent failure and decrease in operation efficiency of the compressor 61 and promote reduction in pressure loss generated in the outdoor heat exchanger 65 and improvement of heat exchange efficiency of the outdoor heat exchanger 65.

Furthermore, as shown in FIG. 6, when the refrigerant circuit 51 performs cooling operation, the high pressure refrigerant may flow into the expansion device 64 after passing through the high pressure refrigerant flow path 4*b*, and the low pressure refrigerant passing through the low pressure refrigerant flow path 4*a* and the high pressure refrigerant passing through the high pressure refrigerant flow path 4*b* may flow in mutually opposite directions. In that case, in particular, when the refrigerant circuit 51 performs cooling operation, gasification and superheat of the low pressure refrigerant passing through the low pressure refrigerant flow path 4*a* and subcooling of the high pressure refrigerant passing through the high pressure refrigerant flow path 4*b* can be reliably achieved. Thus, it is possible to prevent failure or decrease in operation efficiency of the compressor 61 and to promote reduction in pressure loss generated in the indoor heat exchangers 63*a* and 63*b* and improvement of heat exchange efficiency of the indoor heat exchangers 63*a* and 63*b*, although the refrigerant circuit 51 is configured to switch heating operation and cooling operation by switching operation of the four-way valve 62.

Usage Example-2

Figure 7:
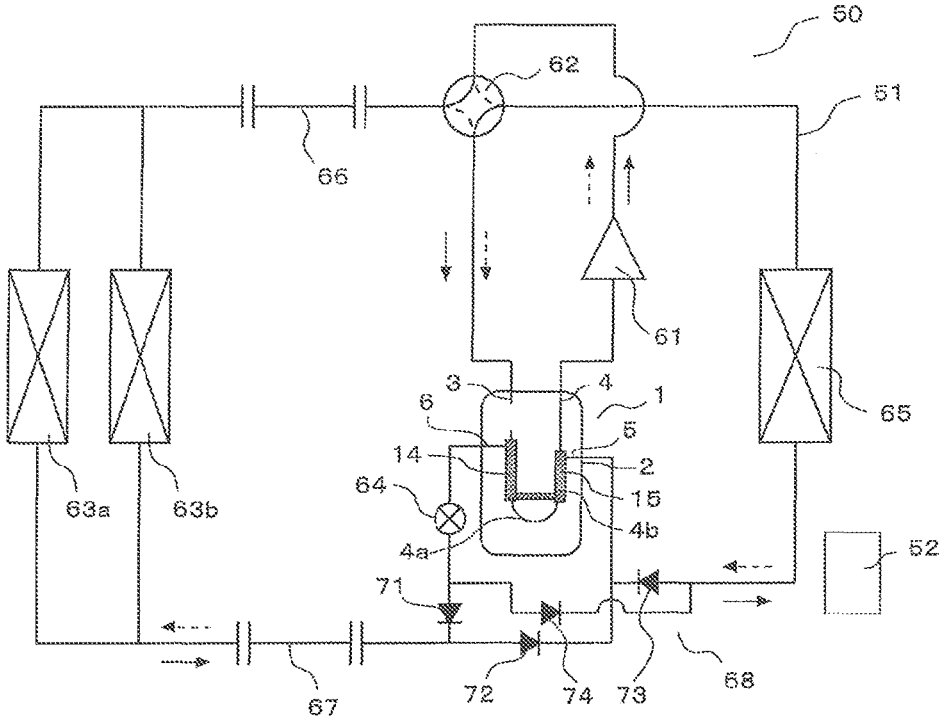
FIG. 7 is a view showing Usage example-2 of the accumulator according to Embodiment 1.
Figure 8:
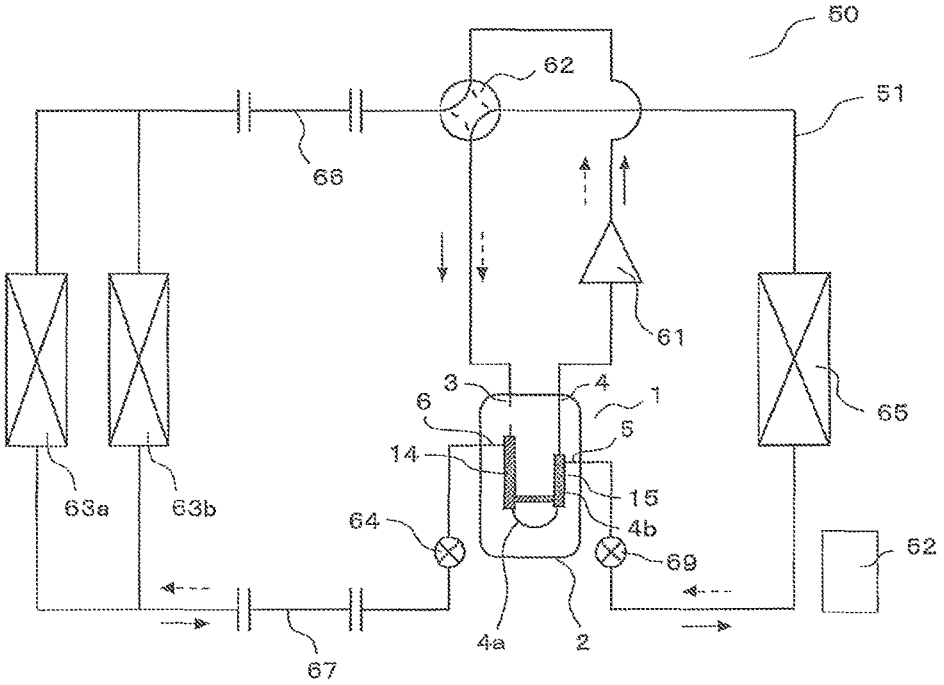
FIG. 8 is a view showing Usage example-2 of the accumulator according to Embodiment 1.

FIGS. 7 and 8 are views showing Usage example-2 of the accumulator according to Embodiment 1. In FIGS. 7 and 8, a flow of refrigerant during heating operation is indicated by the solid arrow, and a flow of refrigerant during cooling operation is indicated by the dotted arrow. Further, a flow path of a four-way valve 62 during heating operation is indicated by the solid line, and a flow path of the four-way valve 62 during cooling operation is indicated by the dotted line.

As shown in FIG. 7, the air-conditioning apparatus 50 includes a flow switching mechanism 68. The flow switching mechanism 68 corresponds to a "second flow switching mechanism" of the present invention.

The flow switching mechanism 68 includes a check valve 71, a check valve 72, a check valve 73, and a check valve 74, and operates so that the high pressure refrigerant that has passed through the high pressure refrigerant flow path 4*b* flows into the expansion device 64 both in a case where the refrigerant circuit 51 performs heating operation and in a case where the refrigerant circuit 51 performs cooling operation. That is, the pipe on an upstream-side of the high pressure refrigerant flow path 4*b* and the pipe on a downstream-side of the expansion device 64 are connected to the flow switching mechanism 68 so that the flow switching mechanism 68 guides the refrigerant that flows out of the indoor heat exchangers 63*a* and 63*b* during heating operation to flow into the high pressure refrigerant inlet tube 5 and the refrigerant that flows out of the outdoor heat exchanger 65 during cooling operation to flow into the high pressure refrigerant inlet tube 5. Further, the flow switching mechanism 68 may be other mechanism such as a four-way valve. When the flow switching mechanism 68 is made up of the check valve 71, the check valve 72, the check valve 73, and the check valve 74, the control system is simplified.

That is, in both cases where the refrigerant circuit 51 performs heating operation and where the refrigerant circuit 51 performs cooling operation, the low pressure refrigerant passes through the container 2 and the low pressure refrigerant flow path 4*a* before being suctioned into the compressor 61, and the high pressure refrigerant flows into the expansion device 64 after passing through the high pressure refrigerant flow path 4*b*. As a result, in both cases where the refrigerant circuit 51 performs heating operation and where the refrigerant circuit 51 performs cooling operation, gasification and superheat of the low pressure refrigerant passing through the low pressure refrigerant flow path 4*a* and subcooling of the high pressure refrigerant passing through the high pressure refrigerant flow path 4*b* can be reliably achieved. Thus, it is possible to prevent failure or decrease in operation efficiency of the compressor 61 and to promote reduction in pressure loss generated in the evaporator and improvement of heat exchange efficiency of the evaporator, although the refrigerant circuit 51 is configured to switch heating operation and cooling operation by switching operation of the four-way valve 62.

Moreover, in both cases where the refrigerant circuit 51 performs heating operation and where the refrigerant circuit 51 performs cooling operation, the low pressure refrigerant passing through the low pressure refrigerant flow path 4*a* and the high pressure refrigerant passing through the high pressure refrigerant flow path 4*b* flow in mutually opposite directions. As a result, in both cases where the refrigerant circuit 51 performs heating operation and where the refrigerant circuit 51 performs cooling operation, gasification and superheat of the low pressure refrigerant passing through the low pressure refrigerant flow path 4*a* and subcooling of the high pressure refrigerant passing through the high pressure refrigerant flow path 4*b* can be further reliably achieved. Thus, it is possible to further prevent failure or decrease in operation efficiency of the compressor 61 and to further promote reduction in pressure loss generated in the evaporator and improvement of heat exchange efficiency of the evaporator, although the refrigerant circuit 51 is configured to switch heating operation and cooling operation by switching operation of the four-way valve 62.

Further, as shown in FIG. 8, the air-conditioning apparatus 50 may include an expansion device 69 instead of the flow switching mechanism 68. During heating operation, the controller 52 controls an opening degree of the expansion device 64 to be almost maximum and controls an opening degree of the expansion device 69, for example, to allow the refrigerant flowing out of the indoor heat exchangers 63*a* and 63*b* to have a predetermined degree of subcooling. During cooling operation, the controller 52 controls the opening degree of the expansion device 69 to be almost maximum and controls an opening degree of the expansion device 64, for example, to allow the refrigerant flowing out of the outdoor heat exchanger 65 to have a predetermined degree of subcooling. The expansion device 69 corresponds to a "second expansion device" of the present invention.

In that case, in both cases where the refrigerant circuit 51 performs heating operation and where the refrigerant circuit 51 performs cooling operation, the high pressure refrigerant flows into either of the expansion device 69 and the expansion device 64 after passing through the high pressure refrigerant flow path 4*b*. As a result, in both cases where the refrigerant circuit 51 performs heating operation and where the refrigerant circuit 51 performs cooling operation, it is possible to prevent failure or decrease in operation efficiency of the compressor 61 and to promote reduction in pressure loss generated in the evaporator and improvement of heat exchange efficiency of the evaporator, although the refrigerant circuit 51 is configured to switch heating operation and cooling operation by switching operation of the four-way valve 62. Furthermore, although FIG. 8 shows the case where the low pressure refrigerant passing through the low pressure refrigerant flow path 4*a* and the high pressure refrigerant passing through the high pressure refrigerant flow path 4*b* during cooling operation flow in mutually opposite directions, the low pressure refrigerant passing through the low pressure refrigerant flow path 4*a* and the high pressure refrigerant passing through the high pressure refrigerant flow path 4*b* during heating operation may flow in mutually opposite directions.

Embodiment 2

The accumulator according to Embodiment 2 will be described below.

The description duplicated with that for the accumulator according to Embodiment 1 is simplified or omitted as appropriate.

<Configuration and Operation of Accumulator>

The configuration and operation of the accumulator according to Embodiment 2 will be described below.

Figure 9:
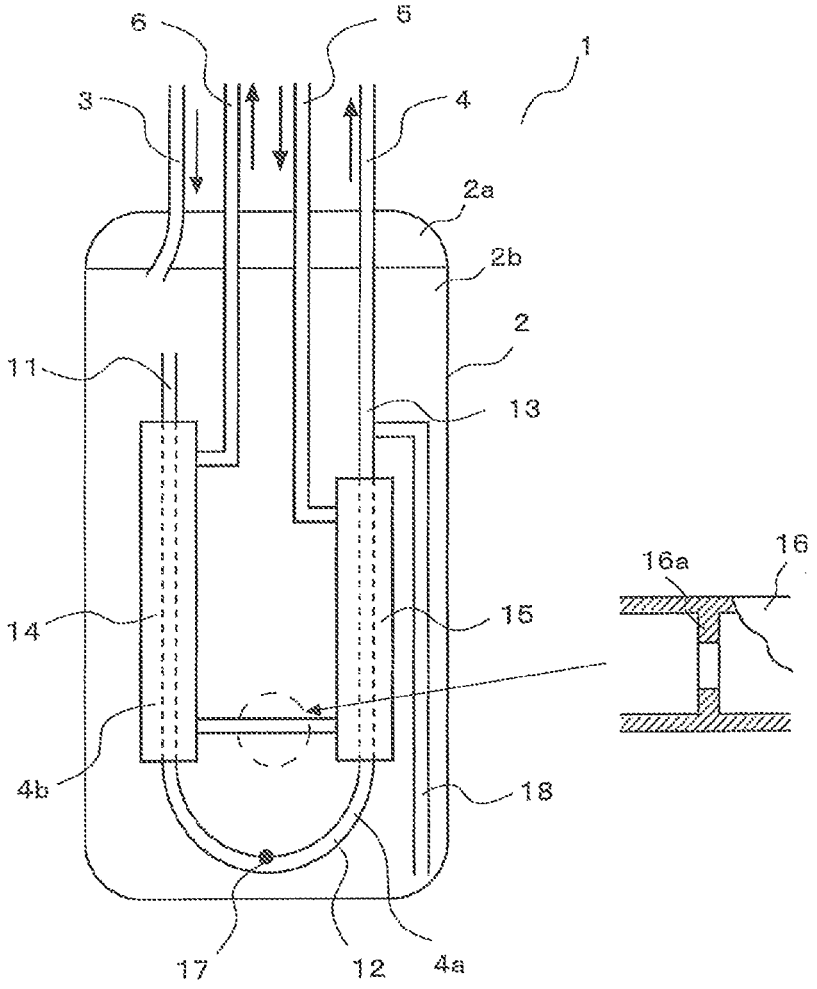
FIG. 9 is a view showing the configuration and operation of the accumulator according to Embodiment 2.

FIG. 9 is a view showing the configuration and operation of the accumulator according to Embodiment 2.

As shown in FIG. 9, the bridging tube 16 includes an aperture 16*a* therein. An opening port area of the aperture 16*a*, that is, the cross sectional area of the flow path is smaller than the cross sectional area of the flow path of the gap between the first tube 11 and the first outer tube 14 and the cross sectional area of the flow path of the gap between the second tube 13 and the second outer tube 15. With this configuration, pressure reduction at the aperture 16*a* can generate a pressure difference between the high pressure refrigerant passing through the gap between the first tube 11 and the first outer tube 14 and the high pressure refrigerant passing through the gap between the second tube 13 and the second outer tube 15. For example, decreasing the wall thickness of the first outer tube 14 or the second outer tube 15 that partially forms the gap on the downstream-side allows for increase in heat transfer efficiency between the high pressure refrigerant passing through the downstream-side gap and having been cooled when the high pressure refrigerant has passed through the upstream-side gap, and the low pressure refrigerant in the container 2, thereby further promoting gasification and superheat of the low pressure refrigerant in the container 2 and subcooling of the high pressure refrigerant passing through the high pressure refrigerant flow path 4*b*.

In particular, when the high pressure refrigerant passing through the high pressure refrigerant flow path 4*b* and the low pressure refrigerant passing through the low pressure refrigerant flow path 4*a* flow in mutually opposite directions, that is, when the high pressure refrigerant flows from the gap between the second tube 13 and the second outer tube 15 to the gap between the first tube 11 and the first outer tube 14, gasification of the low pressure refrigerant around the first tube 11 is promoted, thereby further reliably preventing the liquid refrigerant from entering the upper end of the first tube 11.

Further, the bridging tube 16 may not include the aperture 16*a*, and the cross sectional area of the flow path of the bridging tube 16 itself may be smaller than the cross sectional area of the flow path of the gap between the first tube 11 and the first outer tube 14 and the cross sectional area of the flow path of the gap between the second tube 13 and the second outer tube 15. Further, the bridging tube 16 may include a flow control valve instead of the aperture 16*a*. That is, the cross sectional area of the flow path of at least a part of the bridging tube 16 may be smaller than the cross sectional area of the flow path of the gap between the first tube 11 and the first outer tube 14 and the cross sectional area of the flow path of the gap between the second tube 13 and the second outer tube 15.

Embodiment 3

The accumulator according to Embodiment 3 will be described below.

The description duplicated with that for the accumulator according to Embodiment 1 or Embodiment 2 is simplified or omitted as appropriate.

<Configuration and Operation of Accumulator>

The configuration and operation of the accumulator according to Embodiment 3 will be described below.

Figure 10:
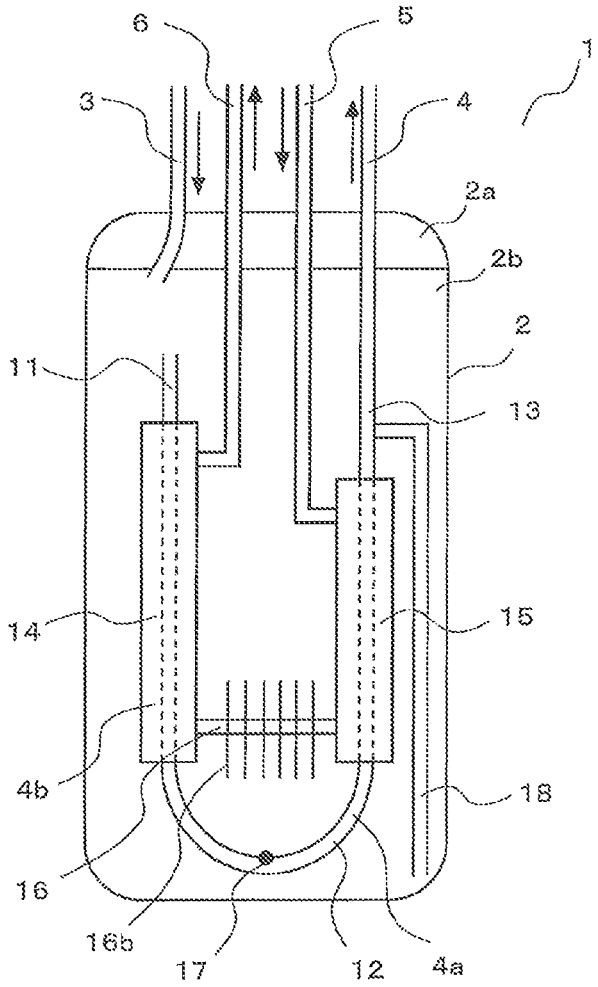
FIG. 10 is a view showing the configuration and operation of the accumulator according to Embodiment 3.

FIG. 10 is a view showing the configuration and operation of the accumulator according to Embodiment 3.

As shown in FIG. 10, the bridging tube 16 includes fins 16*b*. With this configuration, heat exchange efficiency of the low pressure refrigerant outlet body 4 can be improved, thereby further promoting gasification and superheat of the low pressure refrigerant in the container 2 and subcooling of the high pressure refrigerant passing through the high pressure refrigerant flow path 4*b*. Further, at least one of the first outer tube 14 and the second outer tube 15 may include fins. When the first outer tube 14 includes fins, gasification of the low pressure refrigerant around the first tube 11 is promoted, thereby further reliably preventing the liquid refrigerant from entering the upper end of the first tube 11.

The lower ends of the fins 16*b* are located at an upper position relative to the oil return hole 17 and the distal end of the straw tube 18. With this configuration, the oil accumulated at the bottom of the container 2, for example, lubricating oil for the compressor and liquid refrigerant are prevented from being heated by the fins 16*b*, and thus oil components that are not separated are prevented from increasing. This prevention promotes two-layering of oil in the container 2 of, for example, lubricating oil for the compressor and liquid refrigerant. As a result, oil returning property of oil in the accumulator 1, for example, lubricating oil for the compressor is improved, thereby further improving reliability of prevention of failure of compressor or other troubles.

Although Embodiments 1 to 3 have been described above, the present invention is not limited to the description of these embodiments. For example, combination of all or parts of these embodiments is also possible.

REFERENCE SIGNS LIST

1 accumulator 2 container 2*a* cap 2*b* shell 3 low pressure refrigerant inlet tube 4 low pressure refrigerant outlet body 4*a* low pressure refrigerant flow path 4*b* high pressure refrigerant flow path 5 high pressure refrigerant inlet tube 6 high pressure refrigerant outlet tube 11 first tube 12 U-shaped tube 13 second tube 14 first outer tube 15 second outer tube 16 bridging tube 16*a* aperture 16*b* fin 17 oil return hole 18 straw tube 21, 22 support member 21*a*, 22*a* outer peripheral surface 50 air-conditioning apparatus 51 refrigerant circuit 52 controller 61 compressor 62 four-way valve 63*a*, 63*b* indoor heat exchanger 64 expansion device 65 outdoor heat exchanger 66, 67 extension pipe 68 flow switching mechanism 69 expansion device 71 to 74 check valve

The invention claimed is:

1. An accumulator connected to a refrigerant circuit, the accumulator comprising:

a container sealing low pressure refrigerant flowing through a low pressure side of the refrigerant circuit;

a low pressure refrigerant inlet tube allowing the low pressure refrigerant to flow into the container; and a low pressure refrigerant outlet body including an upstream-side tubular section, a low pressure refrigerant turning back section, which communicates with a lower end of the upstream-side tubular section, and a downstream-side tubular section, which has a lower end communicating with the low pressure refrigerant turning back section in the container, wherein the low pressure refrigerant outlet body is configured to allow the low pressure refrigerant in the container to flow from an upper end of the upstream-side tubular section to an upper end of the downstream-side tubular section and to flow out of the container, at least a part of the upstream-side tubular section is covered by a first outer tube with a first gap between the upstream-side tubular section and the first outer tube, at least a part of the downstream-side tubular section is covered by a second outer tube with a second gap between the downstream-side tubular section and the second outer tube, the first outer tube and the second outer tube communicate with each other via a bridging tube, high pressure refrigerant flowing through a high pressure side of the refrigerant circuit passes through the first gap between the upstream-side tubular section and the first outer tube, the bridging tube, and the second gap between the downstream-side tubular section and the second outer tube, the low pressure refrigerant outlet body includes an oil inlet flow path, a downstream end of the oil inlet flow path communicates with a portion of a flow path allowing the low pressure refrigerant flowing from the upper end of the upstream-side tubular section to pass through, the portion is not covered by either of the first outer tube and the second outer tube, an upstream end of the oil inlet flow path is located at a lower end of the container, and the downstream end of the oil inlet flow path is joined to the portion at a location that is above the part of the downstream-side tubular section that is covered by the second outer tube.

2. The accumulator of claim 1, wherein the bridging tube is located at a higher position relative to the second end of the oil inlet flow path.

3. The accumulator of claim 1, wherein a downstream portion of the downstream-side tubular section is not covered by the second outer tube, and the downstream end of the oil inlet flow path communicates with the downstream portion of the downstream-side tubular section.

4. The accumulator of claim 1, wherein the first outer tube has a length that is greater than a length of the second outer tube.

5. The accumulator of claim 1, wherein the upstream-side tubular section, the low pressure refrigerant turning back section, and the downstream-side tubular section are separate members.

6. The accumulator of claim 1, wherein the low pressure refrigerant and the high pressure refrigerant flow into and out of the container via an opening port formed on an upper surface of the container.

7. The accumulator of claim 1, wherein a cross sectional area of a flow path of at least a part of the bridging tube is smaller than a cross sectional area of a flow path of the first gap and a cross sectional area of a flow path of the second gap.

8. An air-conditioning apparatus comprising a refrigerant circuit connecting a compressor, a first flow switching mechanism, an indoor heat exchanger, a first expansion device, an outdoor heat exchanger, and an accumulator by a pipe, and is configured to switch between heating operation and cooling operation by switching operation of the first flow switching mechanism, wherein the accumulator is the accumulator of claim 1, the compressor is connected to the pipe on a downstream side of a flow path through which the low pressure refrigerant passes in the accumulator, and the first expansion device is connected to the pipe on a downstream side of a flow path through which the high pressure refrigerant passes in the accumulator.

9. The air-conditioning apparatus of claim 8, wherein at least when the refrigerant circuit performs heating operation, the compressor is connected to the pipe on the downstream side of the flow path through which the low pressure refrigerant passes in the accumulator, and the first expansion device is connected to the pipe on the downstream side of the flow path through which the high pressure refrigerant passes in the accumulator.

10. The air-conditioning apparatus of claim 9, wherein, when the refrigerant circuit further performs cooling operation, the compressor is connected to the pipe on the downstream side of the flow path through which the low pressure refrigerant passes in the accumulator, and the first expansion device is connected to the pipe on the downstream side of the flow path through which the high pressure refrigerant passes in the accumulator.

11. The air-conditioning apparatus of claim 10, wherein the pipe on an upstream side of the flow path through which the high pressure refrigerant passes in the accumulator and the pipe on a downstream side of the first expansion device are connected to the outdoor heat exchanger and the indoor heat exchanger via a second flow switching mechanism.

12. The air-conditioning apparatus of claim 11, wherein the second flow switching mechanism includes four check valves.

13. The air-conditioning apparatus of claim 10, wherein a second expansion device is connected to the pipe on the upstream side of the flow path through which the high pressure refrigerant passes in the accumulator.

14. The air-conditioning apparatus of claim 8, wherein the low pressure refrigerant passing through the low pressure refrigerant outlet body and the high pressure refrigerant flow in mutually opposite directions in the accumulator.

* * * * *